US006217246B1

(12) United States Patent
Yu

(10) Patent No.: US 6,217,246 B1
(45) Date of Patent: Apr. 17, 2001

(54) TWO-PIECE PAPER FASTENER HAVING ROUNDED SIDES

(76) Inventor: Chung Cheng Yu, 13F, No. 1086, Chung-Ming S. Rd., Taichung City (TW)

( * ) Notice: Subject to any disclaimer, the term of this patent is extended or adjusted under 35 U.S.C. 154(b) by 0 days.

(21) Appl. No.: 09/542,828

(22) Filed: Apr. 4, 2000

(51) Int. Cl.[7] ..... B42D 1/00; B30B 12/00; B42F 3/00; B42F 13/06; B42F 13/08

(52) U.S. Cl. ..... 402/8; 402/17; 402/18; 402/60; 402/62; 402/63; 402/64; 402/68; 24/67 R; 24/67.5; 24/67.11; 24/67 CF

(58) Field of Search ..... 402/8, 17, 18, 402/60, 62, 63, 64, 68; 24/67 R, 67.5, 67.11, 67 CF

(56) References Cited

U.S. PATENT DOCUMENTS 1,927,623 * 9/1933 Anderson ..... 24/153
1,978,569 * 10/1934 Dayton ..... 24/153
3,994,606 * 11/1976 Messmer ..... 402/17
4,070,736 * 1/1978 Land ..... 24/153
4,121,892 * 10/1978 Nes ..... 402/17
5,096,323 * 3/1992 Walker ..... 402/17
5,988,925 * 11/1999 Baggett ..... 402/8

* cited by examiner

*Primary Examiner*—A. L. Wellington
*Assistant Examiner*—Mark Henderson
(74) *Attorney, Agent, or Firm*—Rosenberg, Klein & Lee

(57) ABSTRACT

A two-piece paper fastener includes a prong base with two prongs extending from two ends of a top surface of the prong base. Each of two sides of the prong base has a first flange folded toward a bottom surface so as to define a rounded side. A compressor with two holes through which the two prongs extend and two retainers are slidably mounted to the compressor. Each of two sides of the compressor has a second flange folded toward a bottom surface of the compressor so as to define a rounded side.

1 Claim, 8 Drawing Sheets

TWO-PIECE PAPER FASTENER HAVING ROUNDED SIDES

FIELD OF THE INVENTION

The present invention relates to an improved two-piece paper fastener wherein each side of the prong base and the compressor has a flange folded inward so as not to cut users' fingers.

BACKGROUND OF THE INVENTION

A conventional two-piece paper fastener is shown in FIGS. 5 and 6 and generally includes a prong base 40 and a compressor 30. The prong base 40 has two prongs 41 extending from two ends thereof and two holes 31 are respectively defined through two ends of the compressor 30 so that the two prongs 41 extend through papers (not shown) and the two holes 31 so position the papers between the prong base 40 and the compressor 30. Two retainers 32 are movably mounted to the compressor 30 so that the two prongs 41 can be folded toward each other and are retained by the two retainers 32. The prong base 40 and the compressor 30 are generally made of metal sheets or plastic sheets, and the metal sheets or the plastic sheets are pressed into pieces of the prong bases 40 and the compressors 30 so that the sides of each the prong base 40 and the compressor 30 have sharp raw material which could cut users' fingers. Besides, the prong base 40 and the compressor 30 with sharp raw material on their sides could result in tragedies if children use them as toys so that the conventional two-piece paper fastener needs to be improved.

The present invention intends to provide a two-piece paper fastener that includes a prong base and a compressor, and each side of the prong base and the compressor has a flange folded inward so as to define a smooth side.

SUMMARY OF THE INVENTION

In accordance with one aspect of the present invention, there is provided a two-piece paper fastener comprising a prong base with two prongs extending from two ends of a top surface of the prong base. Each of two sides of the prong base is a rounded side. A compressor with two holes defined through two ends of the compressor. Two retainers are slidably mounted to the compressor and each of two sides of the compressor is a rounded side.

The object of the present invention is to provide an improved two-piece paper fastener wherein the prong base and the compressor have rounded sides so that they will not cut users' fingers.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENT

Referring to FIGS. 1 to 4, a two-piece paper fastener in accordance with the present invention comprises a prong base 20 with two prongs 21 extending from two ends of a top surface of the prong base 20. Each of two sides of the prong base 20 is a rounded side. Each of two sides of the prong base 20 has a first flange 22 folded toward a bottom surface of the prong base 20 so as to define the rounded side.

Figure 1:
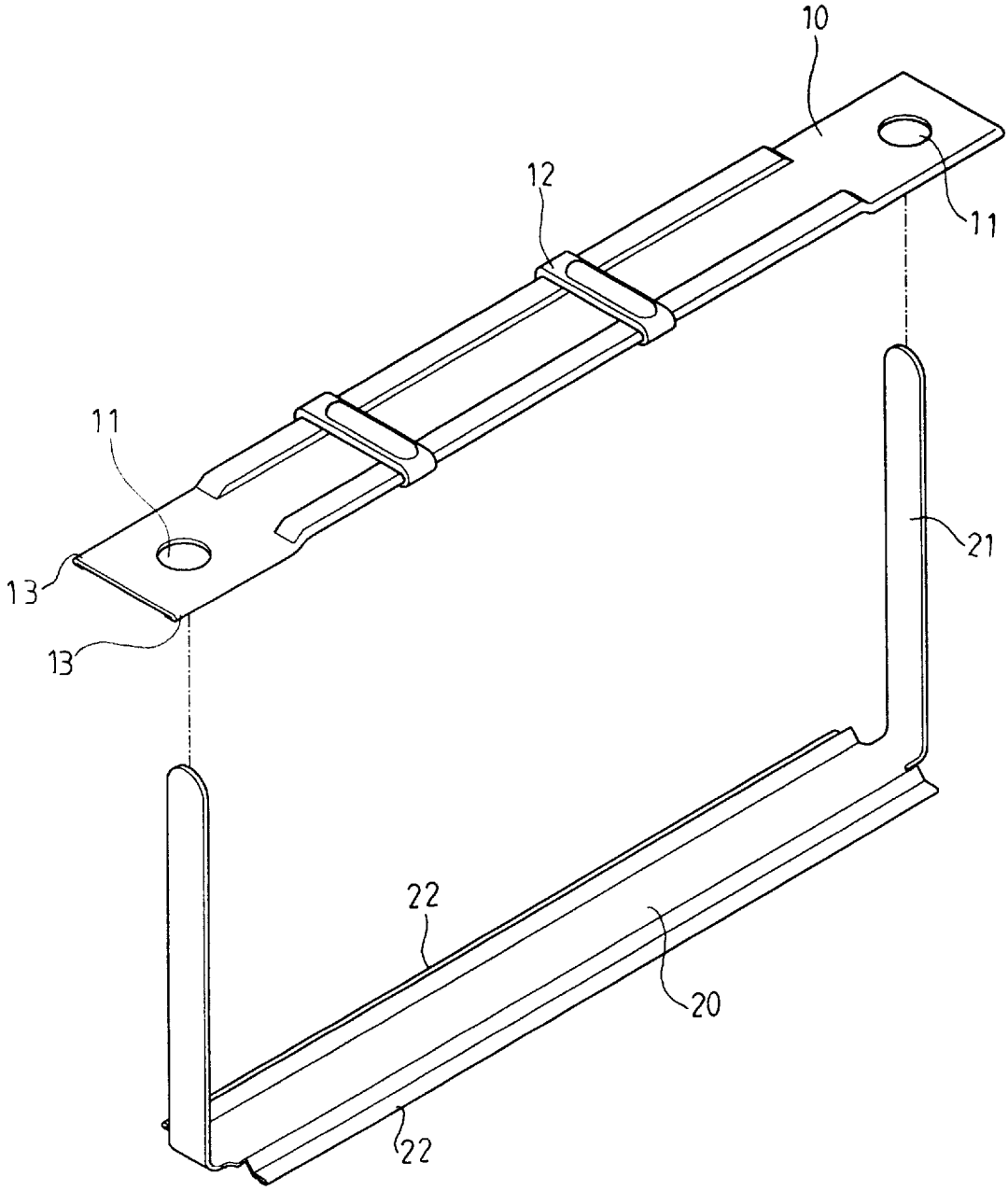
FIG. 1 is an exploded view to show a two-piece paper fastener of the present invention.
Figure 2:
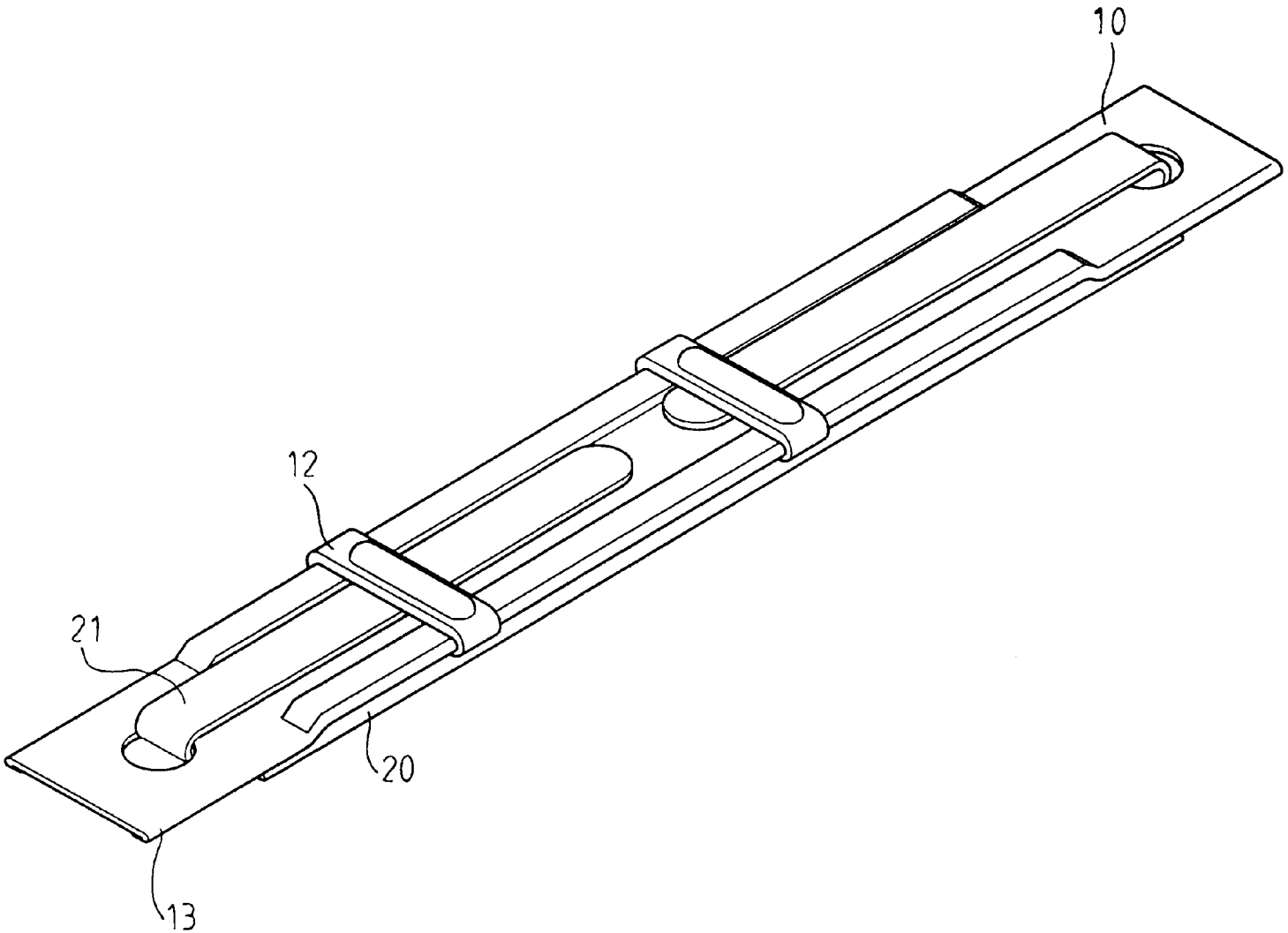
FIG. 2 is a perspective view to show the paper fastener of the present invention.
Figure 3:
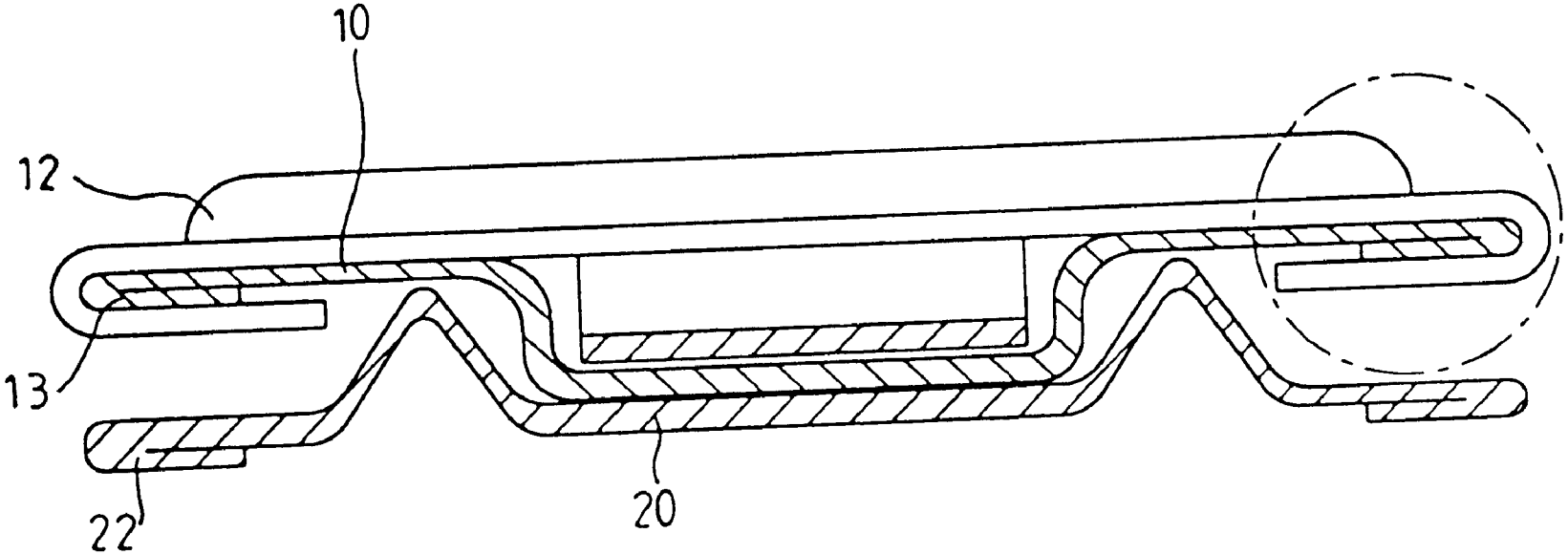
FIG. 3 is a side elevational view, partly in section, of the paper fastener of the present invention.
Figure 3A:
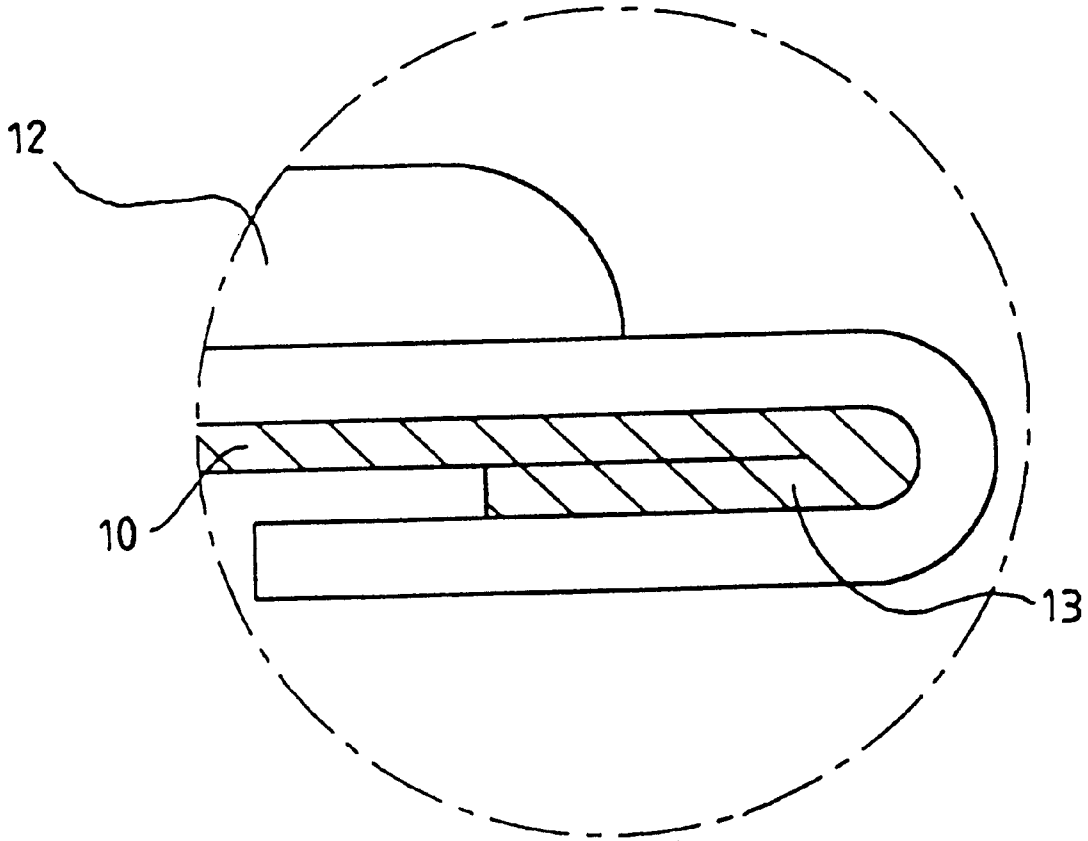
FIG. 3A is an enlarged side elevational view, partly cutaway and in section of FIG. 3.
Figure 4:
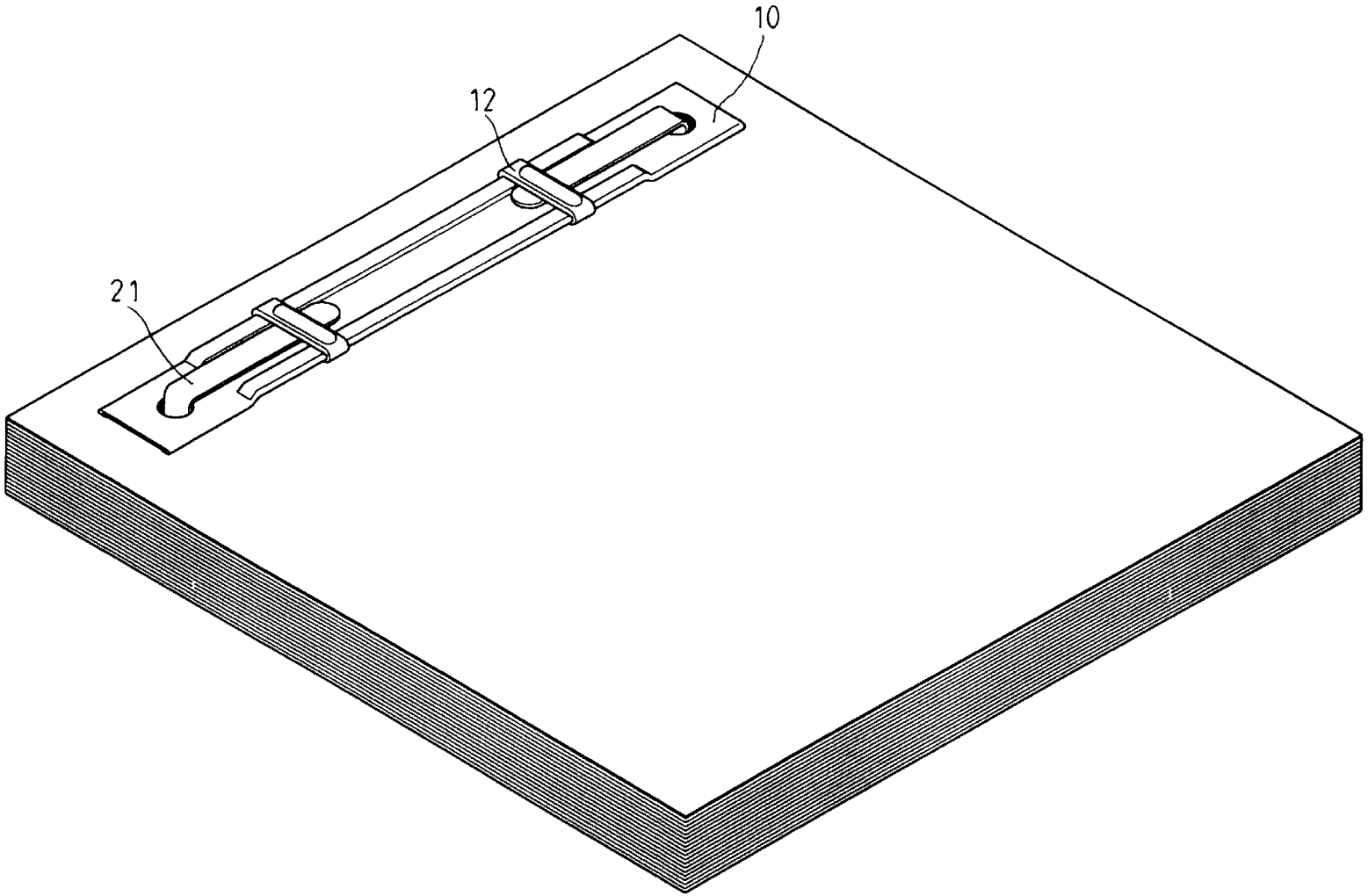
FIG. 4 is a perspective view to show a pile of papers is collected by the paper fastener of the present invention.
Figure 5:
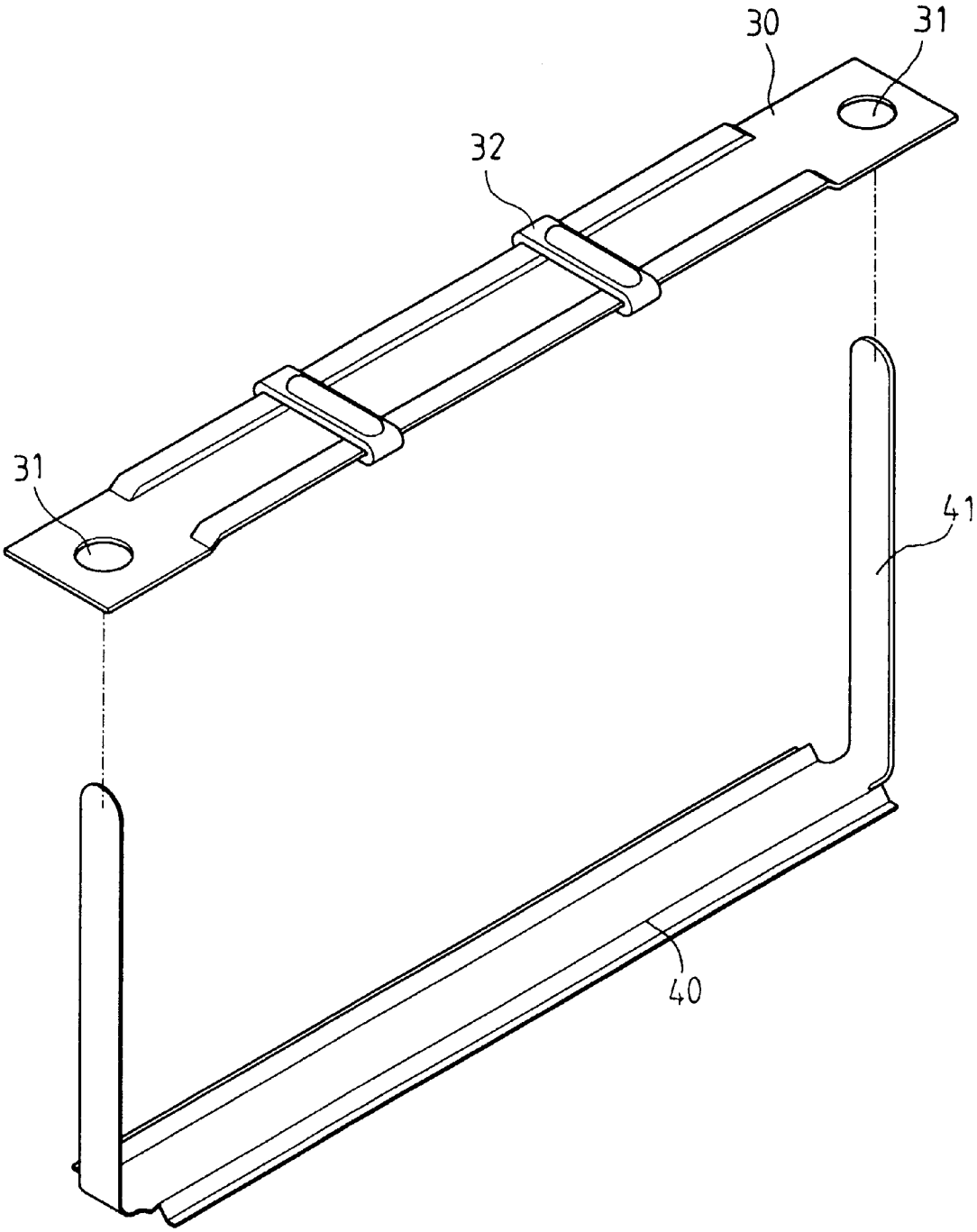
FIG.5 PRIOR ART
FIG. 5 is an exploded view to show a conventional two-piece paper fastener.
Figure 6:
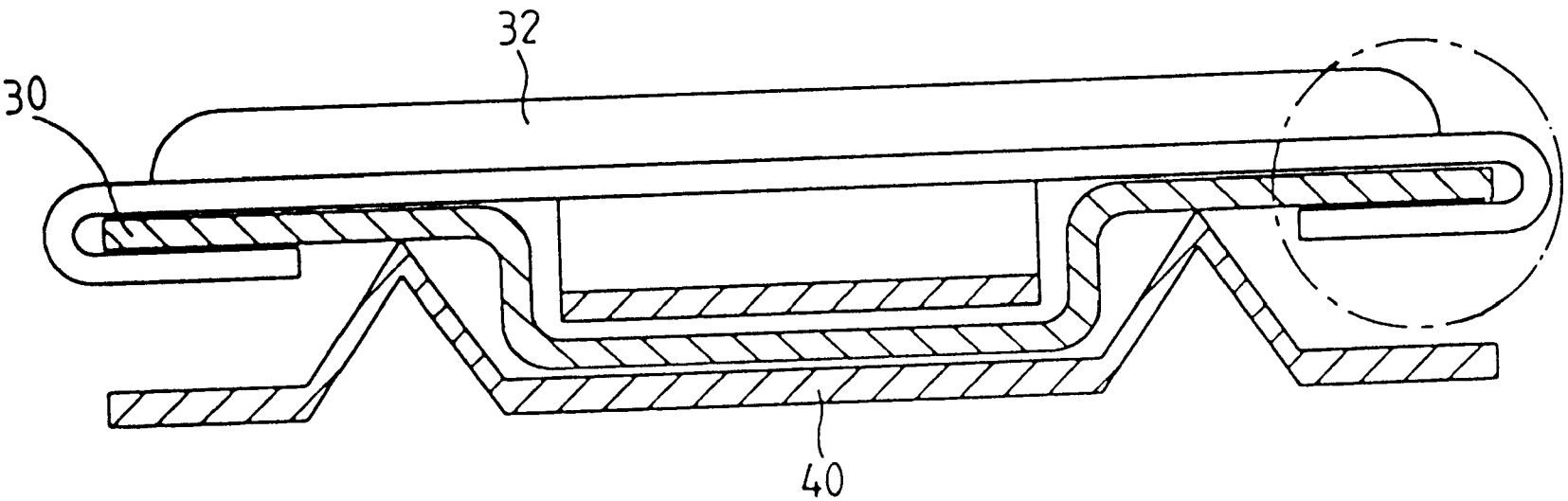
FIG.6 PRIOR ART
FIG. 6 is a side elevational view, partly in section, of the conventional paper fastener.
Figure 6A:
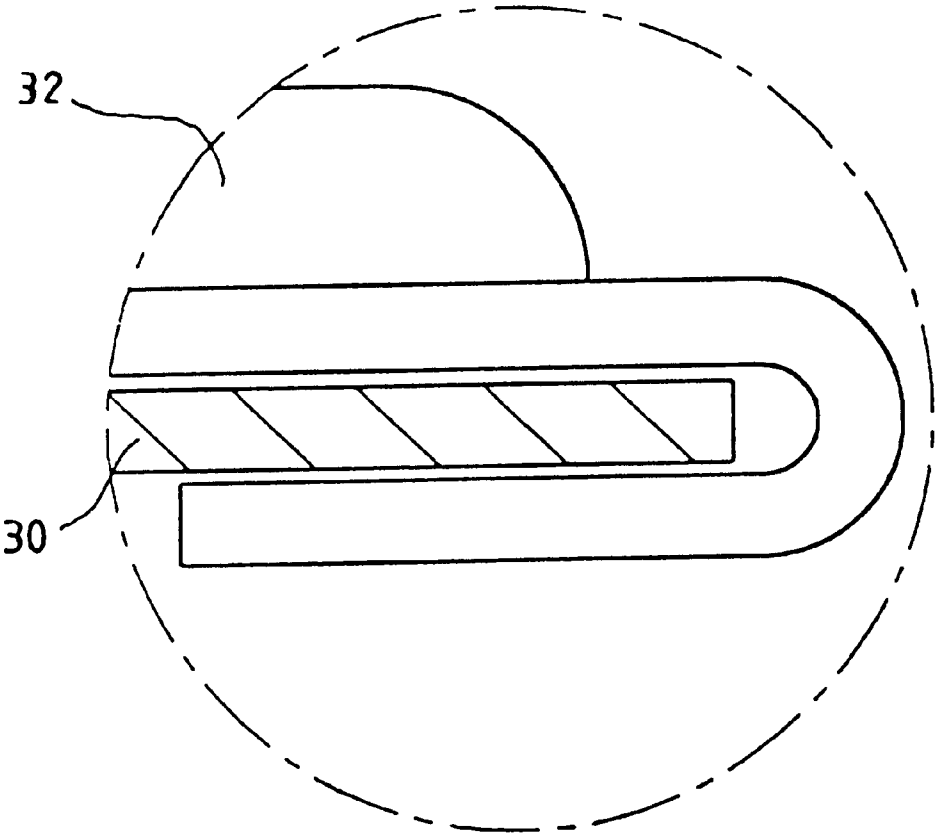
FIG.6A PRIOR ART
FIG. 6A is an enlarged side elevational view, partly in section and cutaway of FIG. 6.

A compressor 10 has two holes 11 defined through two ends of the compressor 10 so that the two prongs 21 extend through a pile of papers as shown in FIG. 4 and through the two holes 11 in the compressor 10. Two retainers 12 are slidably mounted to the compressor 10 and the two prongs 21 are folded and inserted between the retainers 12 and the compressor 10. Each of two sides of the compressor 10 is a rounded side. Each of two sides of the compressor 10 has a second flange 13 folded toward a bottom surface of the compressor 10 so as to define the rounded side.

The first flanges 22 on the prong base 20 and the second flanges 13 on the compressor 10 can be mass-produced by machine so that the manufacturing cost is low. The rounded sides of each of the prong base 20 and the compressor 10 effectively avoid cutting of users' fingers.

While we have shown and described various embodiments in accordance with the present invention, it should be clear to those skilled in the art that further embodiments may be made without departing from the scope and spirit of the present invention.

What is claimed is:

1. A two-piece paper fastener comprising:

a prong base having opposing top and bottom surfaces and two prongs extending out from two ends of said prong base, each of two sides of said prong base having a first flange folded toward said bottom surface of said prong base to form a rounded side edge thereof;

a compressor having opposing top and bottom surfaces and two holes respectively formed through two end portions of said compressor, each of two sides of said compressor having a second flange folded toward said bottom surface of said compressor to form a rounded side edge thereof; and, two retainers slidably mounted on said on said compressor.

* * * * *